United States Patent [19]

Hirose

[11] 4,320,854

[45] Mar. 23, 1982

[54] AUTOMATIC CASH ISSUE MACHINE

[75] Inventor: Minoru Hirose, Yokohama, Japan

[73] Assignee: Tokyo Shibaura Denki Kabushiki Kaisha, Kawasaki, Japan

[21] Appl. No.: 58,439

[22] Filed: Jul. 18, 1979

[30] Foreign Application Priority Data

Jul. 26, 1978 [JP] Japan ..... 53-102669[U]
Aug. 2, 1978 [JP] Japan ..... 53-94333

[51] Int. Cl.[3] ..... B65H 3/02; B65H 29/12

[52] U.S. Cl. ..... 221/12; 221/21; 271/245

[58] Field of Search ..... 221/12, 13, 21; 271/4, 271/245, 246, 263; 194/DIG. 26

[56] References Cited

U.S. PATENT DOCUMENTS 3,765,523 10/1973 Nakanishi ..... 194/4 R
3,937,925 2/1976 Boothroyd et al. ..... 235/377
4,020,972 5/1977 Lundblad ..... 221/21 X
4,159,782 7/1979 Swartzendruber ..... 221/13 X

FOREIGN PATENT DOCUMENTS 52-19480 5/1977 Japan .

*Primary Examiner*—F. J. Bartuska
*Attorney, Agent, or Firm*—Cushman, Darby & Cushman

[57] ABSTRACT

Paper currencies taken out from a cash storing box removably loaded in an automatic cash issue machine by means of a cash take-out mechanism are temporarily accumulated in a temporary cash collecting section. The accumulated currencies are transported toward a cash discharge port by means of a drive endless belt. In this case, the endless belt presses down a bundle of currencies and cooperates with the drive belt to nip and transport the currencies bundled until these are partially exposed to exterior. At this time, a customer may easily take out the currencies bundled.

4 Claims, 7 Drawing Figures

AUTOMATIC CASH ISSUE MACHINE

BACKGROUND OF THE INVENTION

The present invention relates to an automatic cash issue machine which is installed at a lobby in a bank, for example, and issues an amount of cash as required by a customer.

This kind cash issue machine is provided with a cash receptacle between a currency accumulator for temporarily storing paper currencies taken out from a currency stocker and a cash discharge port to discharge or issue the cash to a customer. The notes transferred from the accumulator to the cash receptacle are again accumulated. The customer or user pushes a transparent door slidably provided at the cash discharge port and takes out the accumulated cash from the receptacle.

In the cash issue machine with such a construction, because of use of the cash receptacle, the depth of the machine is longer and therefore a large space is required for installation of the cash issue machine. This is problematic when it must be installed in a restricted or narrow space.

Many attempts to make the machine size small have been made but those have provided only unsatisfactory results. One of the problems encountered in minimizing the size of the cash issue machine is that, in the machine designed small in size, when the machine cover is removed for inspection of the machine, the inside of the machine, particularly a currency collector containing collected currencies, is exposed to the customers. Additionally, the inspection work is also seen by the customers. This is undesirable from a viewpoint of prevention of crimes. In this regard, it is desirable to provide a small-sized cash issue machine free from the just-mentioned problem.

SUMMARY OF THE INVENTION

Accordingly, an object of the invention is to provide an automatic cash issue machine which is compact and installed at a relatively small space, and further may be inspected safely or in the crime-preventive manner.

In an automatic cash issue machine according to the invention having the above object, no cash receptacle is used between the temporary cash accumulator and the cash discharge port in the cash issue machine, and one end of the accumulator is disposed close to the cash discharge port. The paper currencies accumulated in the temporary currency accumulator are transported by means of a transporting means toward the cash discharge port while being bundled by a nipping means. The transportation of the bundle is continued until the bundle is partially exposed to exterior. A customer pulls out the partially exposed bundle. With this construction, no space for the cash receptacle is required thereby shortening the depth of the machine.

The notes erroneously accumulated in number in the temporary cash accumulator are collected into a recovery receptacle or collector box. The collector box is located right under the cash stocker located at the rear side of the machine. The upper opening of the collector, through which the cash is taken out, is normally closed by the bottom of the cash stocker. Therefore, when the machine cover is removed from the machine for its inspection, no cash collected is exposed to the customer. Further, the cash stocker is removable from the machine proper. When the stocker is removed, the upper opening of the collector box is open so that a service man may take out the collected money within the collector box from the rear side of the machine. In this point, the cash issue machine is improved in the prevention of crimes.

In a preferred embodiment according to the invention, a plate-shaped shutter is disposed and vertically movable in a clearance between the temporary cash accumulator and the cash discharge port within the machine proper. The shutter normally closes the cash discharge port for ensuring the prevention of crimes. The shutter has also another function. When the shutter is closed, the leading edges of the paper currencies successively transported into the temporary cash accumulator hit against the shutter so that the leading edges of all the currencies are trued up. A bundle of notes thus trued up is nipped by a nipping means and is transported out from the cash discharge port by a cash transporting means. For this, the notes transported out may easily be held by the hand of the customer and have a good appearance, thus giving a good feeling to the customer.

In another preferred embodiment, the nipping means is comprised of a pair of rollers and an endless belt tightly wound around those rollers. A swing arm is coupled between the rollers and is operatively coupled with a motor, through a link mechanism. The motor drives the swing arm to swing about an axis of one of the rollers and to move the other roller and the endless belt. Therefore, the endless belt is movable between a position to nip the accumulated currencies and another position to release the nipping. When the endless belt is in the release position, the nipping means is positioned out of a moving path of the notes transferred into the temporary cash accumulated section, thereby permit the notes to be smoothly transferred. With this feature, the depth of the machine is shortened.

DETAILED DESCRIPTION OF THE PREFERRED EMBODIMENTS

Figure 1:
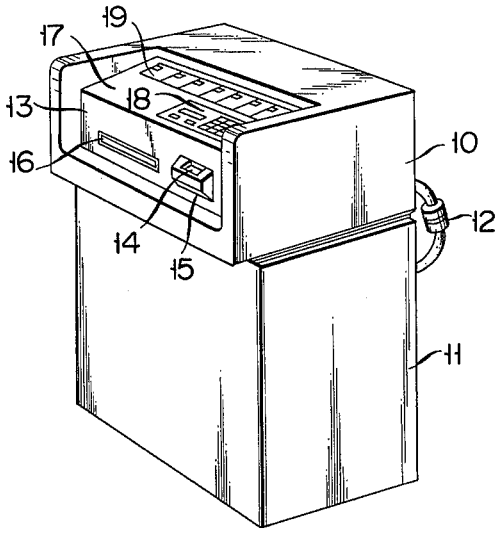
FIG. 1 shows an external appearance of an automatic cash issue machine which is an embodiment according to the invention.

Referring now to FIG. 1, there is shown a general view of an automatic cash issue machine which is an embodiment according to the invention. The machine has a set of upper and lower consoles 10 and 11. The upper console 10 constitutes a main part of the machine for handling transaction mediums such as ID cards, paper currencies, and bills. The lower console 11 constitutes a control part containing intergaces, memories, a power source and the like and is coupled with the main part 10 by means of a cable 12.

In the main part 10, a front user panel 13 is provided with an ID card insertion port or slot 14, a bill take-out port 15 disposed just below the card insertion slot 14, and a cash discharge port or slot 16 adjacent to the bill take-out port 15. A key board 18 and an optical display system 19 are further disposed on a panel 17.

Alternately, the main part 10 may be installed on a counter in a bank and the control part 11 under the counter or at any other place. A plurality of main parts 10 may be connected commonly to a single control part 11. Installed within the main part 10 are all the mechanically operative means such as an ID card reader, a bill printer, and a cash issuing mechanism. Accordingly, even a single unit of the main part is operable as an automatic cash issue machine. The control part 11 is used to connect the main part 10 to other necessary mechanical parts or to a host computer.

Figure 2:
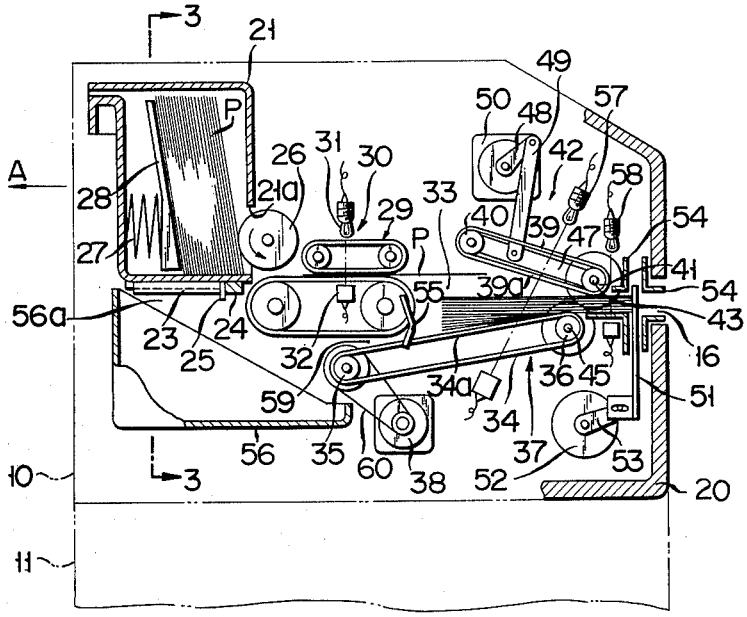
FIG. 2 shows a longitudinal cross sectional view of the upper console which is a major part of the cash issue machine.
Figure 3:
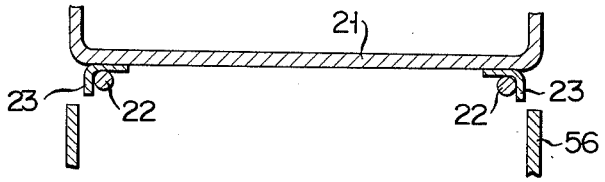
FIG. 3 shows an end view taken along line 3—3 in FIG. 2.

Referring now to FIG. 2, there is shown in internal structure of the main part 10, particularly the cash issue mechanism. In the figure, the right side of the body 20 corresponds to the front side of the actual machine and the left side corresponds to the rear side of the machine. A paper currency cassette or a paper currency stocker 21 which stores a bundle of currencies in an upstanding manner is disposed on the rear side of the machine body 20 and on the upper side of the same. As well illustrated in FIG. 3, the currency stocker 21 is slidably mounted on and along a couple of guide rods 22 engaging with corresponding guide rails 23 which are secured to the bottom of the currency stocker 21. With this arrangement, the stocker 21 is moved in the direction of an arrow A to be removed from the machine body 20. The stocker 21 is loaded into the machine until a stopper 25 fixed to the bottom of the stocker 21 comes in contact with a guide bar 24 fixed to the machine body 20.

A roller 26 partly forming a paper currency take-out mechanism is disposed partly inserted in a paper currency take-out port 21*a* positioned at the front side of the paper currency stocker 21. A back-up mechanism comprising a spring 27 and a plate 28 within the currency stocker 21 biases the paper currency P against the roller 26 to be in contact with the same. A paper currency carrier 29 comprising a pair of upper and lower endlessbelt drive means is provided on the right side of the roller 26, as viewed in the drawing. When the roller 26 rotates counterclockwise as indicated by an arrow, paper currencies are taken out sheet by sheet from the currency stocker 21 and are entered into the pass between the upper and lower drive means and are transferred horizontally and forwardly (i.e. to the right), being nipped between them. A set of a lamp 31 and a photocell 32, which constitute an optical detecting system 30, are disposed with the currency passing between the upper and lower drive means which intervenes between the lamp 31 and the photocell 32, being positioned on the optical path of the optical detecting system 30. The optical detecting system thus arranged is used to count the number of paper currencies P.

The paper currencies drawn off from the paper currency carrier 29 are temporarily gathered in a paper currency-collecting section 33. The section 33 is defined along the upper belt portion 34*a* of a resilient endless belt 34. The endless belt 34 is tightly wound around a pair of rollers 35 and 36. The endless belt 34, together with the rollers 35 and 36, forms a currency transporting mechanism 37. The paper currencies are piled up on the upper belt portion 34*a*. The roller 35 as a drive roller is coupled with a motor 38, through a clutch (not shown) and a chain 60.

Figure 6:
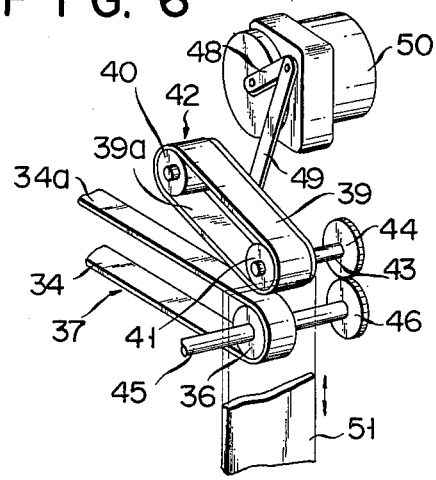
FIG. 6 shows a partial perspective view of a part of the transporting means and the nipping means shown in FIG. 2.

A holding endless belt 39 is tightly wound around a pair of rollers 40 and 41. Those components constitute a nipping mechanism 42. A shaft 43 of the roller 41 is rotatably supported (though not shown) by the body 20. As well illustrated in FIG. 6, the shaft 43 has a gear 44 fixed thereto which is further in engagement with a gear 46 fixed to a shaft 45 of the roller 36 in the currency transporting mechanism 37. With such an arrangement, when the motor 38 is driven, the upper belt portion 34*a* of the endless belt 34 and the lower belt portion 39*a* of the endless belt 39 always move in the same direction.

Figure 4:
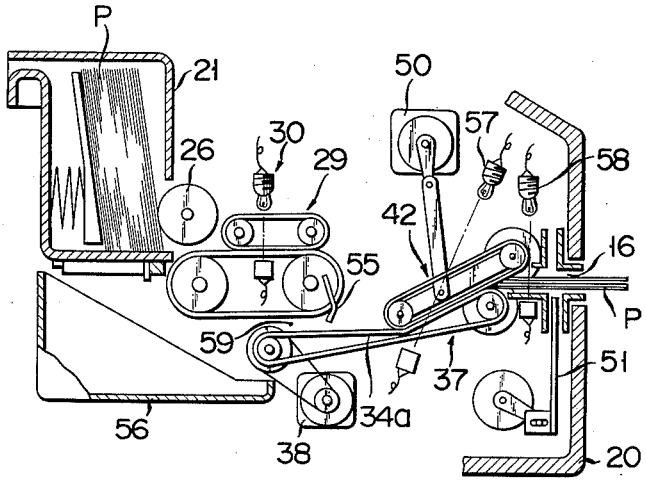
FIGS. 4 and 5 show cross sectional views of the machine for explaining the operation of the machine.
Figure 5:
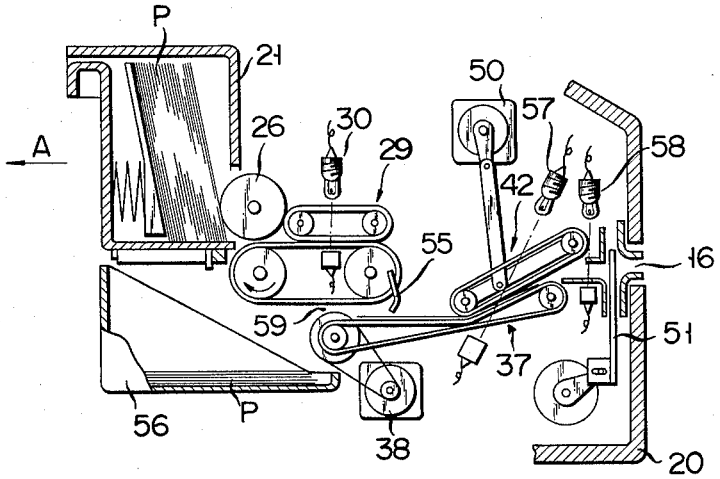

The rollers 40 and 41 of the nipping mechanism 42 are coupled to each other by means of a swing arm 47 which is coupled with a drive motor 50 through levers 48 and 49 constituting a clank or link mechanism. By driving the motor 50, the swing arm 47 selectively swings up and down about the shaft 43 within a given angle and thus the roller 40 moves up and down with the swing of the swing arm 47. At this time, the holding endless belt 39 moves between the upper position shown in FIG. 2 and the nipping position as shown in FIGS. 4 and 5.

One end, or the leading end, of the belt 34 of the transporting mechanism extends near the cash discharge port or slot 16 formed in the machine body 20. Accordingly, one end, or the leading end, of the temporary collecting section 33 is disposed close to the cash discharge port 16. Within the machine body 20, a plate like shutter 51 is movably disposed between the cash discharge port 16 and the end of the endless belt 34. The shutter 51 is movable in vertical direction. The bottom end of the shutter 51 is coupled with a shutter drive mechanism including a rotary solenoid 52 and a lever 53. In response to a selective operation of the solenoid 52, the shutter 51 moves between a fully raised position as shown in FIG. 2 and a fully fallen position as shown in FIG. 4. When the shutter 51 is at the former position, the cash discharge port 16 is closed, while, when it is at the latter position, the port 16 is open. The shutter 51 defines the rightmost end, or the leading end, of the collecting section 33.

In FIG. 2, four guide brackets 54 defining a currency path are provided on both sides of the shutter 51 and at the rear side of the cash discharge port 16. Those brackets 54 also cooperate to guide the vertical moving of the shutter. The endless belts 39 and 34 wound around the upper and lower rollers 41 and 36 form a clearance therebetween communicating with the cash discharge port 16. The physical dimension of the clearance is so selected that the given maximum number of paper currencies simultaneously pass therethrough.

Normally, the holding endless belt 39 is positioned at the fully raised position so that the temporary collecting section 33 is sufficiently opened. Accordingly, paper currencies are dropped one by one into the currency collecting section 33, by way of the currency carrier 29. In the course of the operation, the drive motor 38 drives the upper and the lower belts 34 and 39 at a low speed in the currency transporting direction. In other words, the upper side belt portion 34*a* of the currency receiving belt and the lower side belt portion 39*a* of the holding belt are continuously moving to the right. For this, a paper currency dropped onto the currency collecting section 33 is forwardly moved until the leading edge of the currency comes in contact with the shutter 51. That is to say, the shutter 51 trues up the leading edges of the currencies at the collecting section 33. Therefore, the currencies are accumulated of which the leading edges are trued up by the shutter 51, as shown in FIG. 2.

A tongue like stopping member 55 is fixedly disposed close to the leading edge of the currency carrier 29 and facing the upper side belt portion 34*a* of the belt in the currency transporting mechanism. The stopping member 55 is positioned just beside the upper side belt portion 34*a* and the lower end of the stopper 55 slightly extends downwardly beyond a normal traveling path of the upper side belt 34*a*. The stopper 55 serves to prevent the paper currencies collected at the collecting section 33 from being erronously dropped into a recovery receptacle 56. That is, the stopping member 55 defines the leftmost end, or the trailing end, of the currency collecting section 33.

Incidently, the lower end of the stopping member 55 may be disposed in contact with the upper surface of the upper side belt portion 34*a* of the belt, for the purpose of preventing the erroneous moving of the currency.

A second optical system 57 is disposed at the location of the temporary currency collecting section 33 and a third optical detecting system 58 is disposed just behind the cash discharge port 16. Those optical systems are each comprise a set of a light source lamp and a photodiode, as in the case of the first optical detecting system 30. The second optical detecting system 57 checks as to whether notes reside in the collecting section 33. It is for this reason that an optical path of the second optical detecting system obliquely passes across the collecting section 33, as indicated by a chain line. The third optical detecting system 58 is used to check whether or not the note is completely taken out from the port 16. It is for this reason that an optical path of the third optical detecting system vertically passes from the collecting section 33 to the discharge port 16, as indicated by a chain line.

Right under the cash stocker 21, the box-like receptacle 56 is disposed within the machine body 20. The leading end of the receptacle 56 extends under the currency carrier 29. The half or more of an upper opening 56*a* of the recovery receptacle 56 is normally closed by the stocker 21. The leading end side of the opening 56*a* communicates with the temporary collecting section 33, through a narrow path 59 between the note carrier 29 and the endless belt 34 of the transporting mechanism 37. However, the collector path 59 is normally closed by the stopper 55.

The transport of notes accumulated in collecting section 33 from the cash discharge port 16 will be described with reference to FIG. 4. The motor 50 is first driven to rotate counterclockwise the swing arm 47 about the shaft 43, through the crank or link mechanisms 48 and 49. Upon this, the holding end belt 39 descends to contact the upper surface of the note bundle and cooperates with the note receiving endless belt 34 to hold or nip the bundle of notes. The upper and the lower belt portions 34*a* and 39*a* uniformly and stably hold the bundle over a relatively long range of the note bundle.

Under this condition, the upper and the lower endless belts are moved in the note transporting direction by means of the motor 38. With this transportation, the bundle progresses while being trued up at the leading edge until it is partially extended from the cash discharge port 16, as shown in FIG. 4. At this point, the driving of the upper and the lower belts is stopped.

At this time, a customer or a transactor may grasp notes partially extended from the port or slit 16 and may completely remove them by pulling them. At this time, the driving force from the motor 38 is removed from the lower belt 34 due to the disengagement of a clutch (not shown). Therefore, the drawal of notes from between the upper and lower belt portions 34*a*, 39*a* can be performed smoothly. The bundle partially extended is trued up at the leading edge by the shutter 51 so that the customer may easily take the bundle of notes having a good appearance.

Incidentally, before the notes pass through the slot 16, the shutter 51 is previously moved to the fully fallen position shown in FIG. 4 by means of the operating mechanisms 52 and 53, to open the discharge slit 16.

As described above, the driving of the upper and the lower belts is stopped in a half-exposed state of the notes. The stopping operation of the belts is performed in the following manner. When the second optical detecting system 57 detects the trailing edge of the currency passing the optical detecting system, a detected signal is issued to release the clutch to break the driving relation between the motor and the belts.

When the bundle half-exposed is completely removed from the slot 16, the third optical detecting system 58 detects this state and the shutter 51 is returned to the close position and the nipping mechanism 42 also is returned to the fully raised position.

The collecting operation of notes will be described with reference to FIG. 5. When the note take-out mechanism 26 takes out the erronous number of notes from the note stocker 21, the erronous number is detected by the counting device 30 as the first optical detecting system. Upon this detection, the notes dropped in the temporary collecting section 33 are accumulated. Then, the nipping mechanism 42 is driven by the motor 50 to descend from the fully raised position to the fully fallen position. And it cooperates with the note receiving endless belt to hold a bundle of notes. When the nipping mechanism 42 is in the fully fallen position, that is, in a nipping condition, the holding belt 39 presses down to a great extent the upper side belt portion 34*a* of the note receiving endless belt. As a result, a clearance communicating with the collector path 59 is formed between the lower end of the stopper 55 and the upper side belt portion 34*a*.

Under this condition, the motor 38 is reversed in the rotation. Upon the reverse of the motor rotation, the upper and the lower endless belts 34 and 39 are transported in the opposite direction to the currency transporting direction so that the bundle nipped is transferred to the collector path 59 through the clearance formed and then is collected in the recovery receptacle 56. Also in this case, the paper currencies bundled are nipped by the upper and the lower endless belts 34 and 39 over a relatively long range of the bundle. Accordingly, the collecting operation of notes is performed rapidly and reliably.

The notes collected in the receptacle 56 are taken out to the outside by removing the note stocker 21 above the receptacle 56. In FIG. 5, when the note stocker 21 is drawn in a direction indicated by an arrow A, the upper opening 56*a* of the receptacle 56 which has been covered, is opened. Then, a service man puts his hand into the receptacle 56 from the rear side of the machine and takes out the notes from the receptacle 56. Incidently, in taking out the note stocker 21, even if the cover (with no reference numeral) of the machine is removed, the receptacle 56 is not open to the customer or the transactor. Additionally, the note taking-out work by the service man is performed behind the cash issuing machine. Thus, the cash issuing machine according to the invention is preferable in the light of prevention of crimes.

Figure 7:
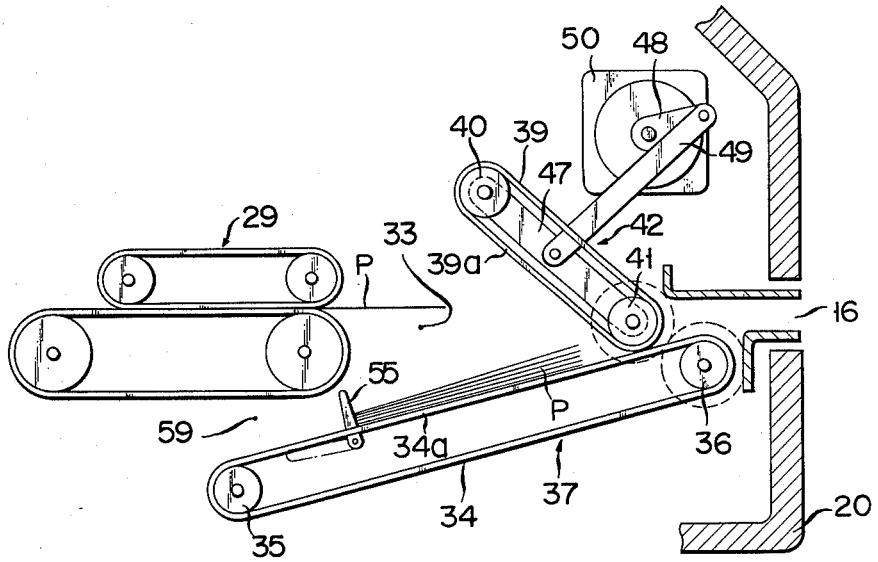
FIG. 7 shows a partial cross sectional view of another embodiment of the cash issue machine according to the invention.

Turning now to FIG. 7, there is shown a second embodiment of the cash issuing machine according to the invention. In the figure, only a major part of the cash issuing mechanism is illustrated in a slightly enlarged manner. Further, like reference numerals in the figure are used to designate like portions in FIG. 2.

In the embodiment, the shutter 51 which was illustrated in FIG. 2 is omitted. In the case of FIG. 2, the stopping member 55 defining the trailing end of the temporary currency collecting section was a fixed tongue like member. The second embodiment employs a stopping member 55 rotatable about an axis, as shown. The stopping member 55 is normally in an upstanding position as indicated by a continuous line. In the currency collecting mode of the machine, it is rotated to be laid down as indicated by a chain line.

The embodiment omitting the shutter is so designed that one 41 of the rollers of the nipping mechanism 42 is located close to the endless belt 34 of the lower transporting mechanism 37 and a portion of the holding endless belt 39 around the roller 41 comes in contact with the upper belt portion 34*a* of the note receiving belt.

In the course of transportation of the note P from the carrier 29 to the temporary note collecting section 33, the nipping mechanism 42 is held in the fully raised position shown in the figure so that the temporary collecting section 33 is left open. The notes successively coming in the section 33 hit at their leading edges against the belt portion around the roller 41 which closes the path continuous to the cash discharge slot 16, with the result that those notes are piled up on the upper belt portion 34*a*, as shown in the figure. At this time, the stopper 55 is standing up thereby to prevent the accumulated notes from dropping through the collector path 59.

When the accumulated notes are transferred toward the cash discharge port 16, the motor 50, the crank mechanisms 48 and 49 and the swing arm 47 cooperate to swing down the nipping mechanism 42 from the raised position to urge the lower side belt portion 39*a* on the upper surface of the accumulated notes. Then, the upper and the lower belts 39 and 34 move together in the note transporting direction to continue the transportation of a bundle of notes until the bundle partially appears from the cash discharge port 16.

Since the note receiving endless belt 34 is made of elastic material, the bundle may smoothly pass under the roller 41 of the nipping mechanism 42.

When the paper currencies in the collecting section 33 are collected, the nipping mechanism 42 swings to the nipping position to nip the notes in cooperation with the upper side belt portion 34*a*. Then, the stopping member 55 is turned down as indicated by the chain line, and the upper and the lower endless belts 39 and 34 are moved in the reversed direction. With this operation, the notes in the collecting section 33 are fed into a recovery receptacle (not shown) through the collecting path 59.

Incidentally, in FIG. 7, the drive motor and the optical detecting system in the currency transporting mechanism are not illustrated for simplicity.

What is claimed is:

1. An automatic cash issue machine for issuing paper notes in response to a customer command, comprising:

(a) a machine body having a cash discharge port at one side thereof;

(b) a paper note stocker within the machine body for storing paper notes;

(c) a take-out mechanism, disposed at one side of the paper note stocker for successively removing paper notes therefrom;

(d) a recovery receptacle, disposed in said body, and having an opening through which paper notes collected therein can be removed the recovery receptacle being positioned under the paper note stocker, the opening of the receptacle being positioned such that it is normally closed by the stocker and opened only when the stocker has been removed from the machine body;

(e) a temporary cash collecting section for accumulating paper notes successively removed from the paper note stocker by the take-out mechanism and having one end thereof extending near the cash discharge port and another end thereof extending to the recovery receptacle;

(f) reversible transporting means, operable in a first direction, to forward paper notes from the temporary cash collecting section to the cash discharge port, and, operable in a second direction opposite to the first direction, to carry paper notes from the temporary cash collecting section to the recovery receptacle; and (g) nipping means movable between a fallen position and a raised position and operatively associated with the transporting means, said nipping means being operable in the fallen position to nip accumulated paper notes and being operable in the raised position to release paper notes previously nipped.

2. An automatic cash issue machine for issuing paper notes in response to a customer command, comprising:

(a) a machine body having a cash discharge port at one side thereof;

(b) a paper note stocker within the machine body for storing paper notes;

(c) a take-out mechanism, disposed at one side of the paper note stocker for successively removing paper notes therefrom;

(d) a recovery receptacle, disposed in said body, and having an opening through which paper notes collected therein can be removed;

(e) a temporary cash collecting section for accumulating paper notes successively removed from the paper note stocker by the take-out mechanism and having one end thereof extending near the cash discharge port and another end thereof extending to the recovery receptacle;

(f) reversible transporting means, operable in a first direction, to forward paper notes from the temporary cash collecting section to the cash discharge port, and, operable in a second direction opposite to the first direction, to carry paper notes from the temporary cash collecting section to the recovery receptacle;

(g) nipping means movable between a fallen position and a raised position and operatively associated with the transporting means, said nipping means being operable in the fallen position to nip accumulated paper notes and being operable in the raised position to release paper notes previously nipped, the reversible transporting means including a first pair of rollers positioned apart from one another and a first endless belt tightly wound around the first pair of rollers, the endless belt having an upper side belt portion, and wherein the nipping means includes a second pair of rollers positioned apart from one another and a second endless belt tightly wound around the second pair of rollers, the second belt having a lower side belt portion; and a tongue like stopping member disposed near the upper side belt portion of the reversible transporting means for preventing paper notes accumulated in the temporary collecting section from being erroneously dropped into the recovery receptacle.

3. An automatic cash issue machine according to claim 2, wherein the first belt is flexible enough to form a clearance between the upper side belt portion and the stopping member when the nipping means is in the fallen position thereby allowing paper notes accumulated in the temporary collecting section to pass into the recovery receptacle through the clearance.

4. An automatic cash issue machine for issuing paper notes in response to a customer command, comprising:

(a) a machine body having a cash discharge port at one side thereof;

(b) a paper note stocker within the machine body for storing paper notes;

(c) a take-out mechanism, disposed at one side of the paper note stocker for successively removing paper notes therefrom;

(d) a recovery receptacle, disposed in said body, and having an opening through which paper notes collected therein can be removed;

(e) a temporary cash collecting section for accumulating paper notes successively removed from the paper note stocker by the take-out mechanism and having one end thereof extending near the cash discharge port and another end thereof extending to the recovery receptacle;

(f) reversible transporting means, operable in a first direction, to forward paper notes from the temporary cash collecting section to the cash discharge port, and, operable in a second direction opposite to the first direction, to carry paper notes from the temporary cash collecting section to the recovery receptacle;

(g) nipping means movable between a fallen position and a raised position and operatively associated with the transporting means, said nipping means being operable in the fallen position to nip accumulated paper notes and being operable in the raised position to release paper notes previously nipped; and (h) a shutter for selectively closing the cash discharge port, and for aligning the leading edges of paper notes being accumulated in the temporary cash collecting section by having them brought into contact with the shutter.

* * * * *